US009322247B2

(12) United States Patent
Rojas et al.

(10) Patent No.: US 9,322,247 B2
(45) Date of Patent: Apr. 26, 2016

(54) SYSTEMS AND METHODS OF HARVESTING INFORMATION FROM A WELL-SITE

(75) Inventors: Fabian Fidel Rojas, Houston, TX (US); Evan Davies, Spring, TX (US); Ronald Johannes Dirksen, Spring, TX (US); Donald Leon Crawford, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 265 days.

(21) Appl. No.: 14/114,982

(22) PCT Filed: Nov. 16, 2011

(86) PCT No.: PCT/US2011/060926

§ 371 (c)(1), (2), (4) Date: Oct. 31, 2013

(87) PCT Pub. No.: WO2013/074095

PCT Pub. Date: May 23, 2013

(65) Prior Publication Data

US 2014/0083688 A1 Mar. 27, 2014

(51) Int. Cl.

| | |
|---|---|
| ***E21B 44/00*** | (2006.01) |
| ***E21B 41/00*** | (2006.01) |
| ***E21B 47/12*** | (2012.01) |

(52) U.S. Cl.

CPC ..... *E21B 41/0092* (2013.01); *E21B 44/00* (2013.01); *E21B 47/12* (2013.01)

(58) Field of Classification Search

CPC ..... E21B 15/00; E21B 41/0092; E21B 44/00; E21B 47/12

See application file for complete search history.

(56) References Cited

U.S. PATENT DOCUMENTS

| | | | | |
|---|---|---|---|---|
| 7,219,723 | B2 | 5/2007 | Barnes et al. | |
| 2008/0071899 | A1 | 3/2008 | Odaka et al. | |
| 2008/0173480 | A1 * | 7/2008 | Annaiyappa | E21B 15/00 175/24 |
| 2010/0114493 | A1 | 5/2010 | Vestal | |

FOREIGN PATENT DOCUMENTS

| | | | |
|---|---|---|---|
| CN | 201314225 | Y | 9/2009 |
| WO | 2009128999 | A1 | 10/2009 |

OTHER PUBLICATIONS

International Preliminary Report on Patentability issued in related International Application No. PCT/US2011/060926 mailed on May 30, 2014, 10 pages.

(Continued)

*Primary Examiner* — William P Neuder

(74) *Attorney, Agent, or Firm* — Alan Bryson; Baker Botts L.L.P.

(57) ABSTRACT

A method and system for collecting information of a rig operation, including subterranean operations at a rig-site. The system may include an integrated control system, wherein the integrated control system monitors one or more rig operations, and comprises a centralized data acquisition server coupled to one or more sensor units of the rig operations. The system may further include a central computer that can communicate with sensor units, and store the data in a central time-synchronized database accessible by a central data acquisition server, wherein the central time-synchronized database collects data from the various sensors to generate a time-synchronized overview of rig operations.

20 Claims, 4 Drawing Sheets

(56) References Cited

OTHER PUBLICATIONS

International Search Report and Written Opinion, International Application No. PCT/US2011/060926, 11 pgs., Jul. 17, 2012.

Office Action with search report issued in related Chinese patent appln. No. 201180074900.5, mailed Dec. 21, 2015 (18 pages with partial translation).

* cited by examiner

SYSTEMS AND METHODS OF HARVESTING INFORMATION FROM A WELL-SITE

CROSS-REFERENCE TO RELATED APPLICATION

This application is a U.S. National Stage Application of International Application No. PCT/US2011/060926 filed Nov. 16, 2011, and which is hereby incorporated by reference in its entirety.

BACKGROUND

Hydrocarbons, such as oil and gas, are commonly obtained from subterranean formations. Although systems for monitoring drilling operations are known, these systems fail to provide an efficient method of collecting information from various drilling operations. Generally, a drilling operation conducted at a wellsite requires that a wellbore be drilled that penetrates the hydrocarbon-containing portions of the subterranean formation. Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation.

Each of these different steps involve a plurality of drilling parameter information provided by one or more information provider units, such as the wireline drum, the managed pressure drilling unit (MPD), underbalanced pressure drilling unit, fluid skid, measurement while drilling (MWD) toolbox, and other such systems. Generally, for operation of a wellsite, it is required that parameters be measured from each of the information provider units at a wellsite.

Traditionally, the data from these information provider units are measured by sensors located at the information provider unit. The data from these sensors are collected at the information provider unit, and transmitted to a storage location on the information provider unit. One or more rig operators may collect such data from the various information provider units. Each of these types of data from the sensors may be located at multiple places, and there is no apparent way to gather the data at a central location for analysis.

These processes of collecting the data from the various information provider units can be time-consuming, cumbersome, and inefficient. With the increasing demand for hydrocarbons and the desire to minimize the costs associated with performing rig operations, there exists a need for automation and collection of various drilling parameters to a central data system. Automation of collection of data may also eliminate human error and increase safety at a wellsite, as well as the cost of operating the wellsite based on the reduction of personnel on the site.

BRIEF DESCRIPTION OF THE DRAWINGS

Some specific example embodiments of the disclosure may be understood by referring, in part, to the following description and the accompanying drawings.

DETAILED DESCRIPTION

Figure 1:
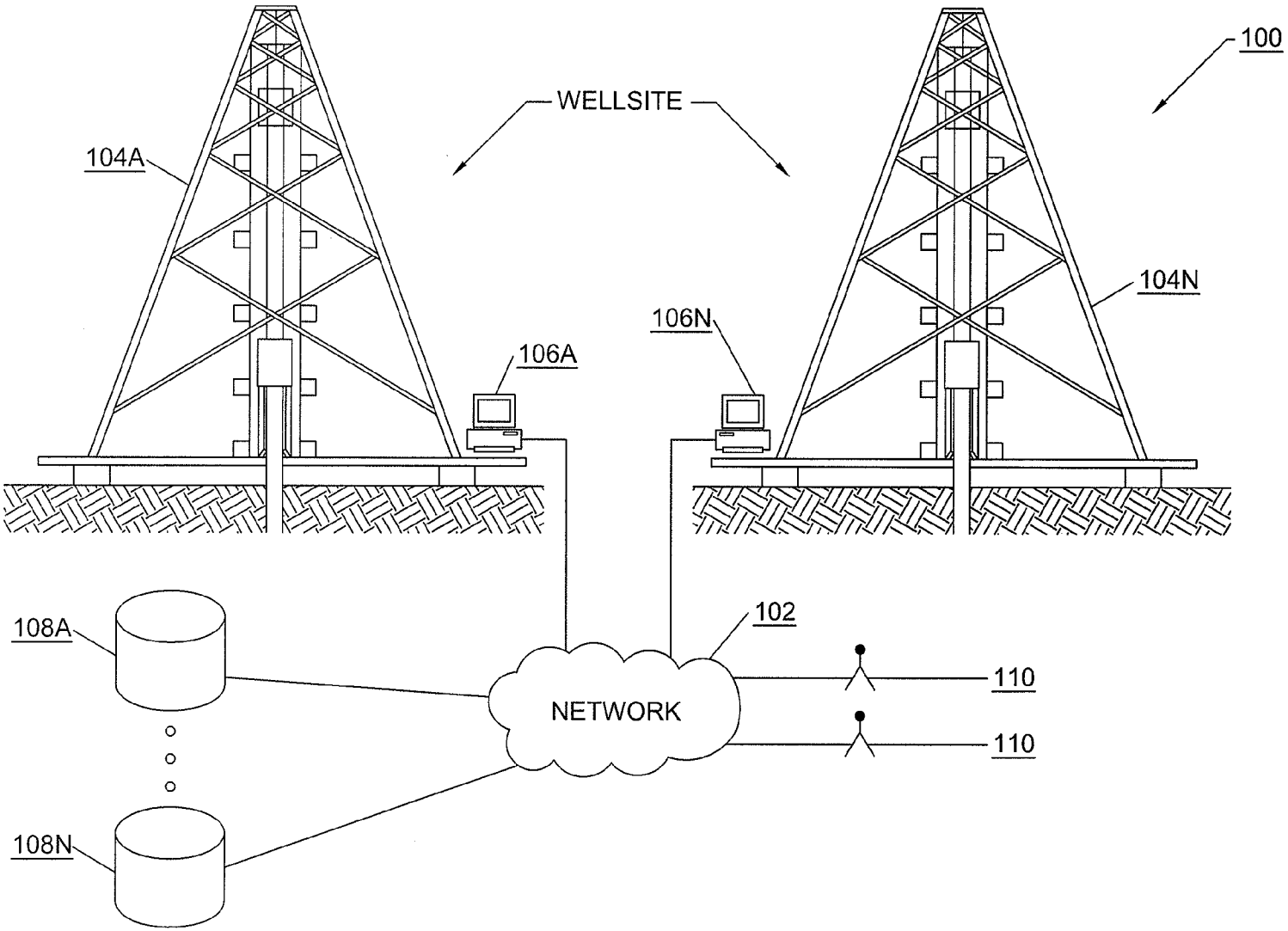
FIG. 1 is a illustrative wellsite system of the invention.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. Devices and methods in accordance with certain embodiments may be used in one or more of wireline, measurement-while-drilling (MWD) and logging-while-drilling (LWD) operations. "Measurement-while-drilling" is the term generally used for measuring conditions downhole concerning the movement and location of the drilling assembly while the drilling continues. "Logging-while-drilling" is the term generally used for similar techniques that concentrate more on formation parameter measurement.

The terms "couple" or "couples," as used herein are intended to mean either an indirect or direct connection. Thus, if a first device couples to a second device, that connection may be through a direct connection, or through an indirect electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present application is directed to using automation in the collection of all relevant drilling sensor and instrumentation data into a central database. The data is available for viewing, processing, correlation, storage and finding in one central location. Multiple information provider units can provide data to a centralized location that can remotely communicate or locally make data available concerning all sensors for rig equipment in one centralized location. Data that is collected can be used in a streamlined workflow by other systems and operators concurrently with acquisition.

In certain embodiments according to the present disclosure, automating the collection of data from various systems in a centralized database may provide a streamlined workflow that other systems and operators can access.

Several drivers exist for automating and centralizing data collection, including improving the compliance and conformance of information at a rigsite, reducing the manpower requirements at a rigsite, and enabling improved analysis of rigsite data.

With reference to the attached figures, certain embodiments of the present invention include a system 100 that may include a network 102 that couples together at least one wellsite 104A-104N. The wellsites 104A-104N may include an information handling system (IHS) 106A-106N that may collect, process, store, correlate, and display various wellsite data and real time operating parameters. The IHS 106A, for example, may receive wellsite data from various sensors at the wellsite, including downhole and surface sensors, as described below. Network 102 may be coupled to multiple communication networks working in conjunction with multiple servers.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

In an illustrative embodiment, the IHS may include an integrated control system for the wellsite data. The wellsite data may be replicated at one or more remote locations relative to the wellsite. For example, the integrated control system may transmit the wellsite data to one or more non volatile machine-readable media 108A-108N. In addition, the integrated control system may transmit data via network 102 and radio frequency transceivers 110 to remote locations. In some embodiments, the non-volatile machine readable media 108A-108N may be representative of servers for storing the wellsite data therein.

The network communication may be any combination of wired and wireless communication. In one example, at least a portion of the communication is transferred across the internet using TCP/IP internet protocol. In some embodiments, the network communication may be based on one or more communication protocols (e.g., HyperText Transfer Protocol (HTTP), HTTP Secured (HTTPS), Application Data Interface (ADI), Well Information Transfer Standard Markup Language (WITSML), etc.). A particular non-volatile machine-readable medium 108 may store data from one or more wellsites and may be stored and retrieved based on various communication protocols. The non-volatile machine-readable media 108 may include disparate data sources (such as ADI, Javi Application Data Interface (JADI), Well Information Transfer Standard Markup Language (WITSML), Log ASCII Standard (LAS), Log Information Standard (LIS), Digital Log Interchange Standard (DLIS), Well Information Transfer Standard (WITS), American Standard Code for Information Interchange (ASCII), OpenWorks, SiesWorks, Petrel, Engineers Data Model (EDM), Real Time Data (RTD), Profibus, Modbus, OLE Process Control (OPC), various RF wireless communication protocols (such as Code Division Multiple Access (CDMA), Global System for Mobile Communications (GSM), etc.), Video/Audio, chat, etc.). While the system 100 shown in FIG. 1 employs a client-server architecture, embodiments are not limited to such an architecture, and could equally well find application in a distributed, or peer-to-peer, architecture system.

Figure 2:
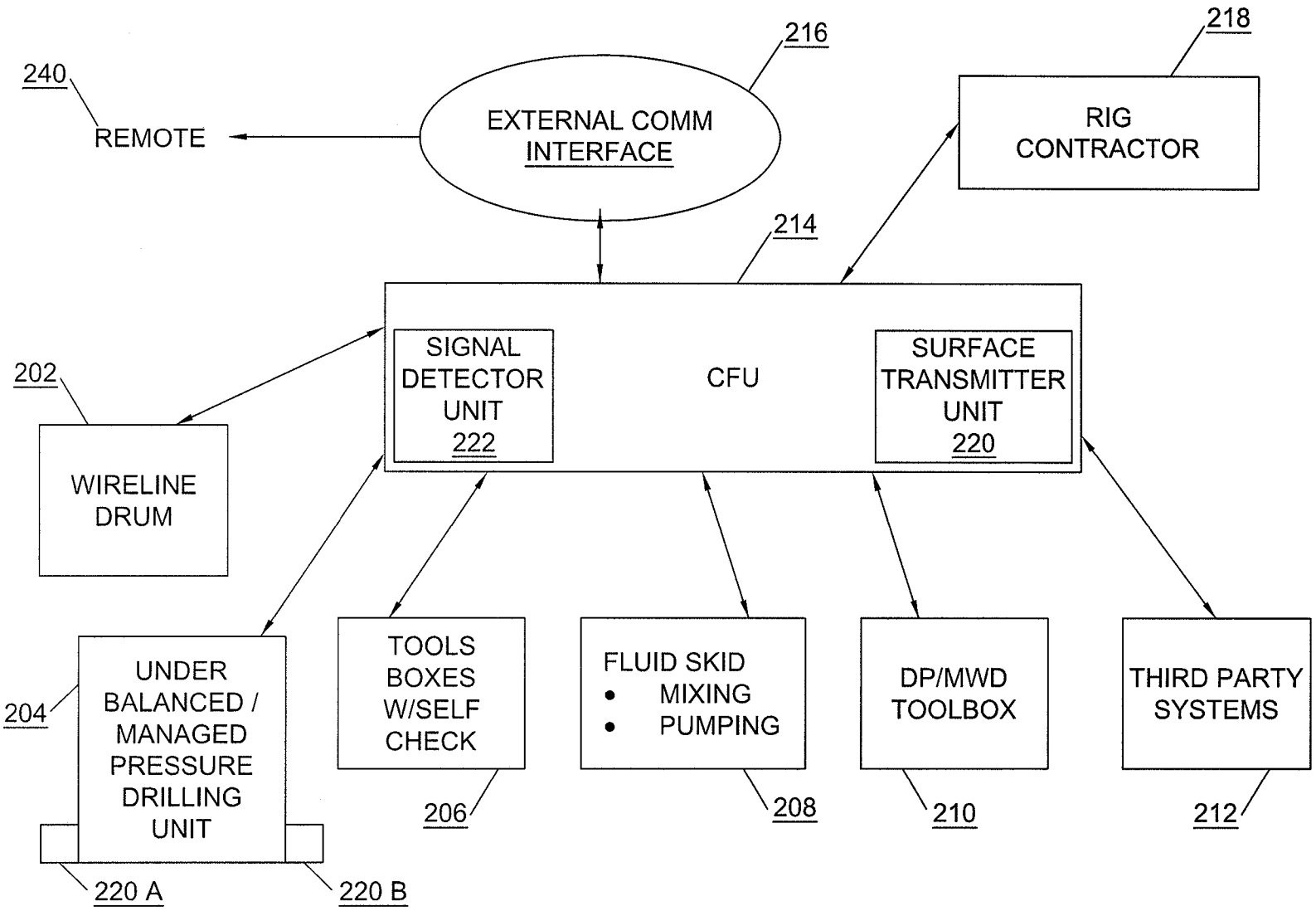
FIG. 2 shows an illustrative improved drilling system in accordance with an exemplary embodiment of the present invention.

FIG. 2 illustrates an information handling system (IHS) 104 that may be used for acquiring wellsite data, according to some embodiments. In the example shown, the IHS 104 may include one or more processors. The IHS 104 may include a memory unit, processor bus, and an input/output controller hub (ICH). The processor(s), memory unit, and ICH may be coupled to the processor bus. The processor (s, memory unit, and ICH may be coupled to the processor bus. The processor(s) may include any suitable processor architecture. IHS 104 may include one or more processors, any of which may execute a set of instructions in accordance with embodiments of the invention.

The memory unit may store data and/or instructions, and may include any suitable memory, such as a dynamic random access memory (DRAM). IHS 104 may also include hard drives such as IDE/ATA drive(s) and/or other suitable computer readable media storage and retrieval devices. A graphics controller may control the display of information on a display device, according to certain embodiments of the invention.

The IHS 104 may also implement a centralized monitoring system using a CFU 214. The system may contain one or more functional units at the rig site that require monitoring. The functional units may include one or more of a wireline drum 202, underbalanced/managed pressure unit 204, tool boxes containing self-check 206, fluid skid 208, including mixing and pumping units, and measurement while drilling toolbox 210. The functional units may include third party functional units 212.

Each functional unit may be communicatively coupled to the CFU 214. For some embodiments of the invention, the CFU 214 may provide an interface to one or more suitable integrated drive electronics drives, such as a hard disk drive (HDD) or compact disc read only memory (CD ROM) drive, or to suitable universal serial bus (USB) devices through one or more USB ports. In certain embodiments, the CFU 214 may also provide an interface to a keyboard, a mouse, a CD-ROM drive, and/or one or more suitable devices through one or more firewire ports. For certain embodiments of the invention, the CFU may also provide a network interface through which CFU can communicate with other computers and/or devices.

In one embodiment, the CFU 214 may be a Centralized Data Acquisition System. In certain embodiments, the connection may be an Ethernet connection via an Ethernet cord. As would be appreciated by those of ordinary skill in the art, with the benefit of this disclosure, the functional units may be communicatively coupled to the CFU 214 by other suitable connections, such as, for example, wireless, radio, microwave, or satellite communications. Such connections are well known to those of ordinary skill in the art and will therefore not be discussed in detail herein. In one exemplary embodiment, the functional units could communicate bidirectionally with the CFU 214. In another embodiment, the functional units could communicate directly with other functional units employed at the rigsite.

In one exemplary embodiment, communication between the functional units may be by a common communication protocol, such as the Ethernet protocol. For functional units that do not communicate in the common protocol, a converter may be implemented to convert the protocol into a common protocol used to communicate between the functional units. With a converting unit, a third party such as a Rig Contractor 218, may have their own proprietary system communicating to the CFU 214. Another advantage of the present invention would be to develop a standard data communication protocol for adding new parameters.

In one embodiment, the functional units may record data in such a manner that the CFU 214 using software can track and monitor all of the functional units. The data will be stored in a database with a common architecture, such as, for example, oracle, SQL, or other type of common architecture.

The data from the functional units may be generated by sensors 220A and 220B, which may be coupled to appropriate data encoding circuitry, such as an encoder, which sequentially produces encoded digital data electrical signals representative of the measurements obtained by sensors 220A and 220B. While two sensors are shown, one skilled in the art will understand that a smaller or larger number of sensors may be used without departing from the scope of the present invention. The sensors 220A and 220B may be selected to measure downhole parameters including, but not limited to, environmental parameters, directional drilling parameters, and formation evaluation parameters. Such parameters may include downhole pressure, downhole temperature, the resistivity or conductivity of the drilling mud and earth formations. Such parameters may include downhole pressure, downhole temperature, the resistivity or conductivity of the drilling mud and earth formations, the density and porosity of the earth formations, as well as the orientation of the wellbore. Sensor examples include, but are not limited to: a resistivity sensor, a nuclear porosity sensor, a nuclear density sensor, a magnetic resonance sensor, and a directional sensor package. Additionally, formation fluid samples and/or core samples may be extracted from the formation using formation tester. Such sensors and tools are known to those skilled in the art. In an embodiment, the sensors may be based on a standard hardware interface that could add new sensors for measuring new metrics at the rigsite in the system.

In one example, data representing sensor measurements of the parameters discussed above may be generated and stored in the CFU 214. Some or all of the data may be transmitted by data signaling unit. For example, an exemplary function unit, such as an underbalanced/managed pressure drilling unit 204 may provide data in a pressure signal traveling in the column of drilling fluid to the CFU 214 may be detected at the surface by a signal detector unit 222 employing a pressure detector in fluid communication with the drilling fluid. The detected signal may be decoded in CFU 214. In one embodiment, a downhole data signaling unit is provided as part of the MPD unit 204. Data signaling unit may include a pressure signal transmitter for generating the pressure signals transmitted to the surface. The pressure signals may include encoded digital representations of measurement data indicative of the downhole drilling parameters and formation characteristics measured by sensors 220A and 220B. Alternatively, other types of telemetry signals may be used for transmitting data from downhole to the surface. These include, but are not limited to, electromagnetic waves through the earth and acoustic signals using the drill string as a transmission medium. In yet another alternative, drill string may include wired pipe enabling electric and/or optical signals to be transmitted between downhole and the surface. In one example, CFU 214 may be located proximate the rig floor. Alternatively, CFU 214 may be located away from the rig floor. In certain embodiments, a surface transmitter 220 may transmit commands and information from the surface to the functional units. For example, surface transmitter 220 may generate pressure pulses into the flow line that propagate down the fluid in drill string, and may be detected by pressure sensors in MPD unit 204. The information and commands may be used, for example, to request additional downhole measurements, to change directional target parameters, to request additional formation samples, and to change downhole operating parameters.

In addition, various surface parameters may also be measured using sensors located at functional units 202 . . . 212. Such parameters may include rotary torque, rotary RPM, well depth, hook load, standpipe pressure, and any other suitable parameter of interest.

Any suitable processing application package may be used by the CFU 214 to process the parameters. In one embodiment, the software produces data that may be presented to the operation personnel in a variety of visual display presentations such as a display.

The operations will occur in real-time and the data acquisition from the various functional units need to exist. In one embodiment of data acquisition at a centralized location, the data is pushed at or near real-time enabling real-time communication, monitoring, and reporting capability. This allows the collected data to be used in a streamline workflow in a real-time manner by other systems and operators concurrently with acquisition.

As shown in FIG. 2, in one exemplary embodiment, the CFU 214 may be communicatively coupled to an external communications interface 216. The external communications interface 216 permits the data from the CFU 214 to be remotely accessible by any remote information handling system communicatively coupled to the remote connection 140 via, for example, a satellite, a modem or wireless connections. In one embodiment, the external communications interface 216 may include a router.

In accordance with an exemplary embodiment of the present invention, once feeds from one or more functional units are obtained, they may be combined and used to identify various metrics. For instance, if there is data that deviates from normal expectancy at the rig site, the combined system may show another reading of the data from another functional unit that may help identify the type of deviation. For instance, if a directional sensor is providing odd readings, but another sensor indicates that the fluid is being pumped nearby, that would provide a quality check and an explanation for the deviation. As would be appreciated by those of ordinary skill in the art, with the benefit of this disclosure, a CFU 214 may also collect data from multiple rigsites and wells to perform quality checks across a plurality of rigsites.

Figure 3:
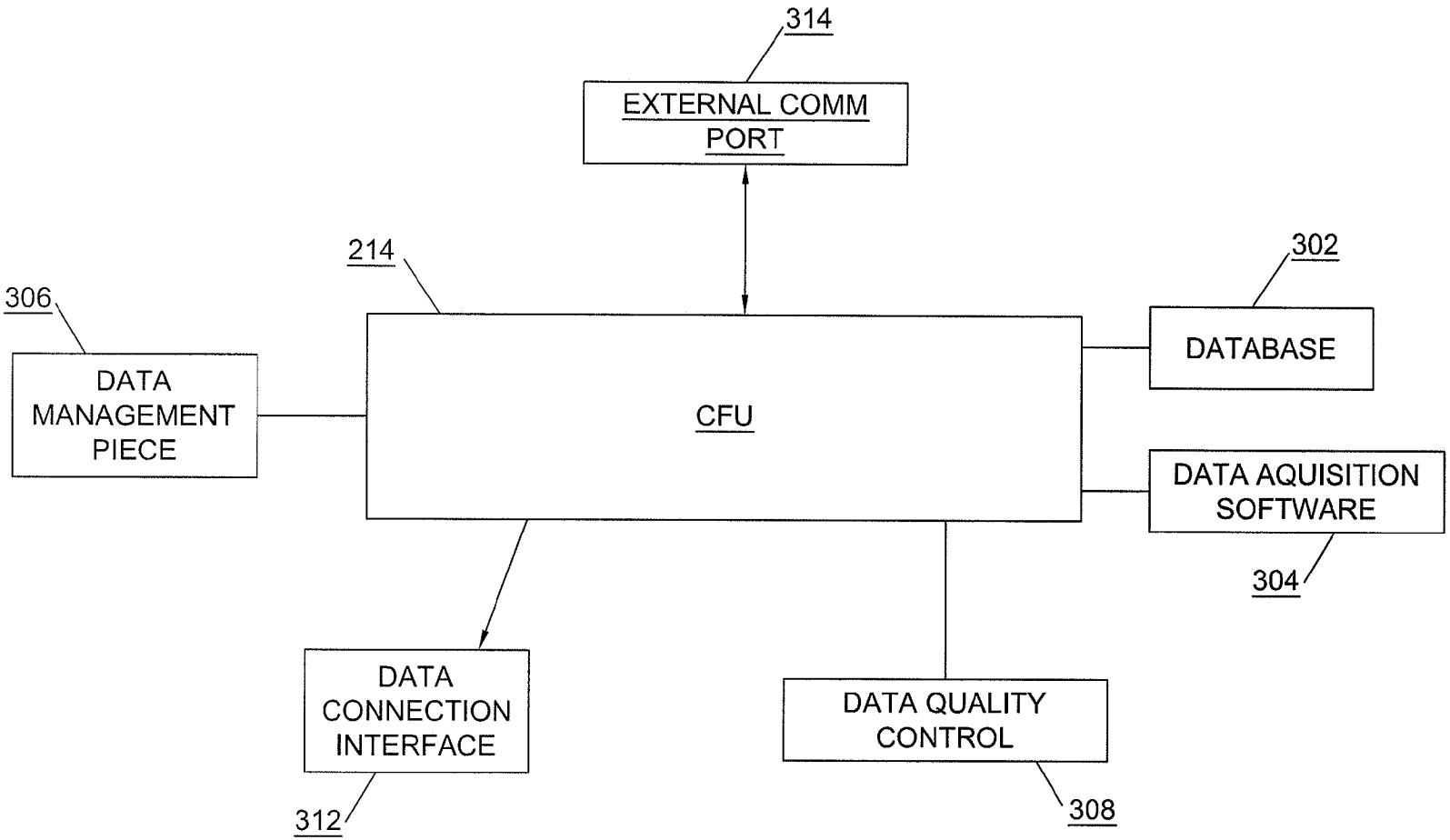
FIG. 3 shows an exemplary monitoring unit in accordance with an exemplary embodiment of the present invention.

FIG. 3 depicts a CFU 214 in accordance with an exemplary embodiment of the present invention. The Centralized Data Acquisition System 214 may collect, store, and report data from a variety of functional units as discussed above with reference to FIG. 2. In one embodiment, the Centralized Data Acquisition System 214 may include a database 302 which may, for example, store the data collected from one or more functional units. As would be appreciated by those of ordinary skill in the art, with the benefit of this disclosure, the database 302 may include a computer-readable media. In one embodiment, the Centralized Data Acquisition System 214 may also include a data acquisition software 304 for performing, for example, the collection and reporting functions. In one exemplary embodiment, the data acquisition software 304 may offer visualization of the various sensors and tools dynamically and/or in real-time. Users of the system, such as subject matter experts, could then be able to access the information provided by the data acquisition software 304 remotely and use it to analyze system performance and make operational decisions.

The central database 302 may also be a time-synchronized database to collect all available data from the well site. The central database 302 may also collect data from various sensors including sensors on surface sources, rig, motors, pumps, tanks (stress, torque, load, flow, temperature, levels, speed, current, voltage, power, audio/video, worker location/position, inventory, RFID, etc.). This information could be pulled together a time synchronized overview of rig operations above and below ground. By having this information collected in a time synchronized database, the system would provide insight into the relationships between the overall environments and allow forensics of the overall system. The data could be stored locally in a hardened environment or remotely for data integrity. This would allow the system to function like the black box on an aircraft recording data up to and potentially after time of failure.

In one exemplary embodiment, the Centralized Data Acquisition System 214 may further include a data management component 306. In one embodiment, the data management component 306 may also include security software. As would be appreciated by those of ordinary skill in the art, with the benefit of this disclosure, the security software may regulate access to system information by containing user accounts, administrative accounts and other tools that may be used to regulate data management. Further, the data management component 306 may include a centralized audit trail system that may provide a common reporting structure and system. In one embodiment, the data management component 306 may further provide reporting and standardization of deliverables.

As would be appreciated by those of ordinary skill in the art, with the benefit of this disclosure, the CFU 214 may be implemented on virtually any type of information handling system regardless of the platform being used. Moreover, one or more elements of the information handling system may be located at a remote location and connected to the other elements over a network. In a further embodiment, the information handling system may be implemented on a distributed system having a plurality of nodes. Such distributed computing systems are well known to those of ordinary skill in the art and will therefore not be discussed in detail herein.

As shown in FIG. 3, the CFU 214 may further include a data quality control component 308 for monitoring the quality of data acquired from the different functional units. In one exemplary embodiment, the data quality control component 308 may notify an operator when a particular sensor fails to provide data that meets preset quality standards.

Figure 4:
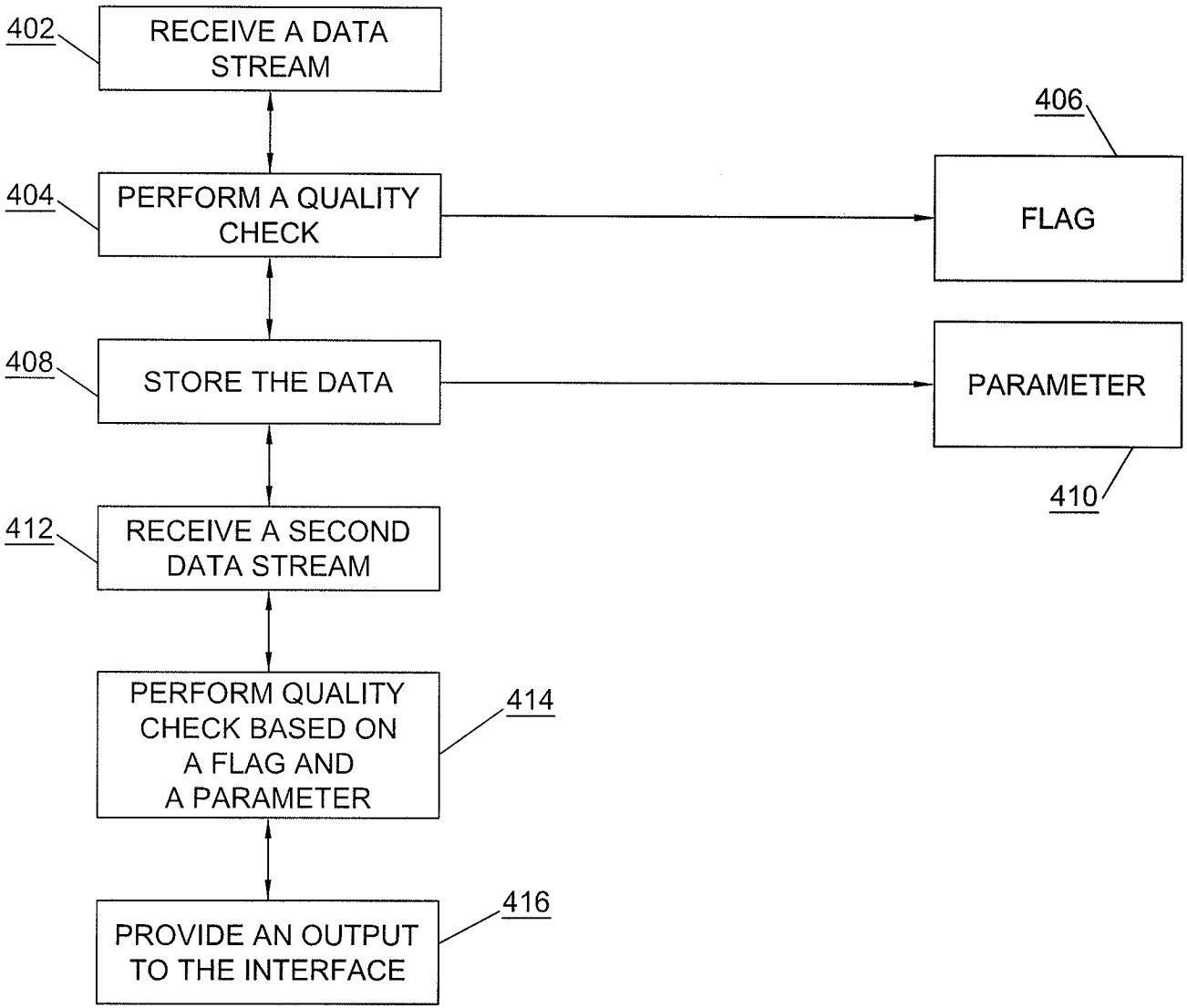
FIG. 4 is a flow chart illustrating a quality check in accordance with an exemplary embodiment of the present invention.

FIG. 4 depicts an exemplary implementation of performing a quality check using the data quality control component 308. At step 402, data is received from a functional unit. Depending on the flag status 404, a quality check is performed on the data at step 406. The data is then stored at step 408 based on a parameter setting 410. A second data stream is then received from the functional unit at step 412. At step 414 a quality check is performed on the second data stream using the flag status 404 and the parameter setting 410. Finally at step 412 an output may be provided such as, for example, a visual indication for action or an automated action for a device. Information obtained from a rigsite may also serve as a quality check measurement in future rigsite developments.

Returning to FIG. 3, a CFU manager 310 may be communicatively coupled to one or more functional units through the data connection interface 312. The CFU manager 310 may control and/or coordinate the operations of the various CFU 214 components as shown in FIG. 3. Additionally, the CFU manager 310 may communicate with the external communications interface 216 through the external communication port 314.

The centralized collection and storage of data may also be available for other jobs to perform quality check of integrated data. Additional software may also provide for pattern recognition and case based reasoning based on models developed based on the centralized collection of data. Specifically, the collection of data over a set period may be used to predict future system performance and requirements. The centralized collection and storage of data may also provide an option for synchronizing recorded events to a central time clock, such as the central time clock of the information handling system. This could be advantageous when analyzing the rig system to find correlations between events and for forensic analysis of subsystem failures. For example, a series of data obtained from functional units would provide a true sequence of events prior to an event (such as a subsystem failure) at a rigsite. Additionally, information obtained from a rigsite may also serve as a quality check measurement in future rigsite developments.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

The invention claimed is:

1. A system for collecting information of a rig operation, the system comprising:

an integrated control system;

wherein the integrated control system monitors one or more rig operations;

wherein the integrated control system comprises a centralized data acquisition server communicatively coupled to one or more functional units;

at least one memory;

at least one processor executing the steps comprising:

receiving data from a sensor corresponding to the one or more functional units;

storing the data in a central time-synchronized database in the at least one memory, wherein the central time-synchronized database is accessible by the centralized data acquisition server;

collecting the data from a plurality of the functional units to generate a time synchronized overview of rig operations; wherein the overview of rig operations is operable to monitor the data from the plurality of the functional units at a single location;

monitoring a quality of the data based, at least in part, on a flag status;

processing the data from the plurality of functional units to generate a report, wherein the report is accessible by a rig operation personnel on a display, further wherein the report is operable to identify a metric, wherein the metric is operable to assist the rig operation personnel in analyzing deviations in the one or more rig operations.

2. The system of claim 1, wherein the one or more functional units are selected from the group consisting of a Wireline drum, an underbalanced/managed pressure drilling unit, a tool box containing self-check, a fluid skid, and a measurement while drilling toolbox.

3. The system of claim 1, wherein the one or more functional units comprises sensors that can measure one of surface sources, rig, motors, pumps, tanks, stress, torque, load, flow, temperature, levels, speed, current, voltage, power, audio, video, worker, location, position, inventory, or RFID.

4. The system of claim 1, wherein the one or more functional units communicate with the integrated control system through a common communication protocol.

5. The system of claim 1, wherein the centralized data acquisition server is communicatively coupled to a remote information handling system.

6. The system of claim 1, wherein the centralized data acquisition server processes information received from the one or more functional units, and wherein the centralized data acquisition server uses the processed information to monitor the rig operations.

7. The system of claim 1, wherein the centralized functional unit at least one of collects, stores, and reports data received from the one or more functional units.

8. The system of claim 1, wherein the centralized data acquisition server comprises at least one of a data management component, a data connection interface, a data quality control component, and a database.

9. The system of claim 1, wherein the centralized data acquisition server further comprises a user interface, wherein the user interface is capable of providing access to the system, wherein the access may be one of local or remote to the rig.

10. The system of claim 1, wherein the central time-synchronized database is stored locally in a hardened environment.

11. A method of integrating rig operations comprising:

monitoring one or more rig operations, wherein an integrated control system comprises a centralized data acquisition server communicatively coupled to one or more functional units;

receiving data from a sensor corresponding to the one or more functional units;

storing the data in a central time-synchronized database in at least one memory, wherein the central time synchronized database is accessible by the centralized data acquisition server;

collecting the data from a plurality of the functional units to generate a time synchronized overview of rig operations, wherein the overview of rig operations is operable to monitor the plurality of the functional units at a single location;

monitoring a quality of the data based, at least in part, on a flag status; and processing the data from the plurality of functional units to generate a report, wherein the report is accessible by a rig operation personnel on a display, further wherein the report is operable to identify a metric, wherein the metric is operable to assist the rig operation personnel in analyzing deviations in the one or more rig operations.

12. The method of claim 11, wherein the centralized data acquisition server comprises at least one of a data management component, a data connection interface, a data quality control component, and a database.

13. The method of claim 11, wherein the one or more functional units are selected from the group consisting of a Wireline drum, an underbalanced/managed pressure drilling unit, tool boxes containing self-check, a fluid skid, and a measurement while drilling toolbox.

14. The method of claim 11, further comprising communicatively coupling the centralized data acquisition server to a remote information handling system.

15. The method of claim 11, further comprising processing the data received from the one or more functional units and using the processed data to monitor the rig operations.

16. The method of claim 11, wherein the centralized data acquisition server further comprises a user interface, wherein the user interface is capable of providing access to the centralized data acquisition server, wherein the access may be one of local or remote to the rig.

17. The method of claim 11, wherein the centralized data acquisition server further receives instructions from a remote location to adjust a parameter of a functional unit during performance of a rig operation.

18. The method of claim 17, wherein the parameter comprises one of a downhole parameter or a directional target parameter.

19. An integrated rig operation control system comprising:

an integrated control system comprising a centralized data acquisition server communicatively coupled to one or more functional units;

wherein the centralized data acquisition server receives data from a sensor communicatively coupled to one or more functional units;

wherein the data is collected in a central time-synchronized database accessible by the centralized data acquisition server;

wherein the central time-synchronized database collects the data from the plurality of the functional units to generate a time synchronized overview of rig operations, wherein the overview of rig operations is operable to monitor the plurality of the functional units at a single location;

wherein the centralized data acquisition server provides realtime access to the status of the one or more functional units at a central database;

wherein the centralized data acquisition server monitors a quality of the data based, at least in part, on a flag status;

wherein the centralized data acquisition server processes the data from the plurality of functional units to generate a report, wherein the report is accessible by a rig operation personnel on a display, further wherein the report is operable to identify a metric, wherein the metric is operable to assist the rig operation personnel in analyzing deviations in the one or more rig operations.

20. The system of claim 19, wherein the one or more functional units communicate with the integrated control system through a common communication protocol.

* * * * *